US008718532B2

(12) United States Patent
Lee et al.

(10) Patent No.: US 8,718,532 B2
(45) Date of Patent: May 6, 2014

(54) IMAGE FORMING APPARATUS CAPABLE OF FORMING A DUPLEX IMAGE ON ONE SHEET

(75) Inventors: Jin-soo Lee, Suwon-si (KR); Jae-yong Kim, Suwon-si (KR); Ki-hun Kim, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 805 days.

(21) Appl. No.: 11/941,255

(22) Filed: Nov. 16, 2007

(65) Prior Publication Data

US 2008/0118293 A1 May 22, 2008

(30) Foreign Application Priority Data

Nov. 21, 2006 (KR) ..... 10-2006-115506

(51) Int. Cl.
*G03G 15/00* (2006.01)
*B65H 1/04* (2006.01)

(52) U.S. Cl.
USPC ..... 399/393; 399/401

(58) Field of Classification Search
USPC ..... 399/401, 393
See application file for complete search history.

(56) References Cited

U.S. PATENT DOCUMENTS

| | | | | |
|---|---|---|---|---|
| 5,132,742 | A | 7/1992 | Goto | |
| 7,639,965 | B2 * | 12/2009 | Palumbo et al. | 399/107 |
| 2005/0002689 | A1 | 1/2005 | Jeong et al. | |
| 2005/0035523 | A1 * | 2/2005 | Triplett et al. | 271/3.14 |
| 2005/0074266 | A1 * | 4/2005 | Hiramoto et al. | 399/391 |
| 2005/0129439 | A1 * | 6/2005 | Asano | 399/401 |
| 2005/0207780 | A1 | 9/2005 | Tonges et al. | |
| 2006/0291931 | A1 * | 12/2006 | Kobayashi | 399/392 |
| 2007/0018381 | A1 * | 1/2007 | Gotoh | 271/245 |
| 2007/0048004 | A1 * | 3/2007 | Murrell | 399/110 |
| 2007/0172255 | A1 * | 7/2007 | Nanno et al. | 399/124 |
| 2007/0247511 | A1 * | 10/2007 | Palumbo et al. | 347/224 |
| 2007/0273085 | A1 * | 11/2007 | Nanno et al. | 271/171 |
| 2012/0007307 | A1 * | 1/2012 | Nanno et al. | 271/225 |

FOREIGN PATENT DOCUMENTS

| | | | | |
|---|---|---|---|---|
| EP | 0 402 836 | | 6/1990 | |
| JP | 02231324 | A * | 9/1990 | B65H 3/00 |
| JP | 3-235968 | | 10/1991 | |
| JP | 07179237 | A * | 7/1995 | G03G 15/00 |
| JP | 7-325437 | | 12/1995 | |
| JP | 2001-235905 | | 8/2001 | |
| JP | 2002-328500 | | 11/2002 | |

(Continued)

OTHER PUBLICATIONS

Office Action issued by European Patent Office in European Patent Application No. 07120409.3-1240 on May 26, 2009.

(Continued)

*Primary Examiner* — Nguyen Ha
(74) *Attorney, Agent, or Firm* — Staas & Halsey LLP

(57) ABSTRACT

An image forming apparatus, including an image forming part which forms an image on a printing medium, a main feeding part which accommodates the printing medium and supplies the printing medium to the image forming part, and a reversing part which transfers the printing medium, on which an image is formed on a first surface thereof in the image forming part, to the main feeding part, wherein the main feeding part includes a feeding roller part which re-feeds the printing medium, having been transferred through the reversing part, to the image forming part.

21 Claims, 4 Drawing Sheets

(56) References Cited

FOREIGN PATENT DOCUMENTS

| | | | | | |
|---|---|---|---|---|---|
| JP | 2003201045 | A | * | 7/2003 | ..... B65H 9/14 |
| JP | 2005-112605 | | | 4/2005 | |
| JP | 2006-232440 | | | 9/2006 | |
| KR | 1999-38171 | | | 6/1999 | |
| KR | 2004-32616 | | | 4/2004 | |
| KR | 2005-56877 | | | 6/2005 | |

OTHER PUBLICATIONS

Korean Office Action issued May 6, 2011 in corresponding Korean Patent Application 10-2006-0115506.
Korean Office Action issued Sep. 5, 2011 in corresponding Korean Patent Application 10-2006-0115506.
Korean Decision of Rejection mailed Nov. 30, 2011 issued in corresponding Korean Patent Application No. 10-2006-0115506.

* cited by examiner

IMAGE FORMING APPARATUS CAPABLE OF FORMING A DUPLEX IMAGE ON ONE SHEET

CROSS-REFERENCE TO RELATED APPLICATION

This application claims the benefit of Korean Patent Application No. 2006-115506, filed Nov. 21, 2006 in the Korean Intellectual Property Office, the disclosure of which is incorporated herein by reference.

BACKGROUND OF THE INVENTION

1. Field of the Invention

Aspects of the present invention relate to an image forming apparatus, and, more particularly, to an image forming apparatus having an improved feeding configuration that minimizes a size of a main body of the image forming apparatus.

2. Description of the Related Art

An image forming apparatus prints image data on a printing medium, such as paper, according to a printing signal applied from a host apparatus such as a personal computer (PC). In general, the image forming apparatus comprises a supplying part which supplies individual sheets of printing media, an image forming part which forms an image on a printing medium fed from the supplying part by a feeding part, and a discharging part which discharges the image-formed printing medium. Recently, as new printing technology has been developed, image forming apparatuses also have been made to comprise a duplex printing function in which images are printed on both sides of the printing medium.

FIG. 1 is a sectional view schematically illustrating a configuration of an image forming apparatus 10 having a conventional duplex printing function. As shown in FIG. 1, the conventional image forming apparatus 10 comprises a feeding cassette 20 in which printing media are stored, an image forming part 30 which forms an image on a printing medium fed from the feeding cassette 20, a discharging part 40 through which the printing medium is discharged after the image is formed thereon, and a reversing part 50 which changes a feeding direction of the printing medium discharged through the discharging part 40 and re-feeds the same printing medium to the image forming part 30.

However, in the conventional image forming apparatus 10, the reversing part 50, which reverses the feeding direction of the printing medium from the discharging part 40 to transfer the printing medium toward the feeding cassette 20, is separately provided on an upper side of the feeding cassette 20. Accordingly, since the reversing part 50 requires a space with a predetermined height h1 inside a main frame 60, the entire height of the image forming apparatus 10 is determined by the sum of the height h1 of the reversing part 50 and the height h2 of the feeding cassette 20. Accordingly, the height of the reversing part 50 needs to be minimized so as to reduce the height and the size of the image forming apparatus 10.

SUMMARY OF THE INVENTION

Accordingly, it is an aspect of the present invention to provide an image forming apparatus with an improved configuration of a reversing part, and which minimizes the size of a main body thereof.

The foregoing and/or other aspects of the present invention can be achieved by providing an image forming apparatus, including an image forming part which forms an image on a printing medium, a main feeding part which accommodates the printing medium and supplies the printing medium to the image forming part, and a reversing part which transfers the printing medium, on which an image is formed on a first surface thereof in the image forming part, to the main feeding part, wherein the main feeding part includes a feeding roller part which re-feeds the printing medium, having been transferred through the reversing part, to the image forming part.

According to an aspect of the invention, the image forming apparatus further comprises: a casing which accommodates the image forming part; and a sub-feeding part outside of the casing and which supplies the printing medium to an interior of the casing, wherein the feeding roller part transfers the printing medium supplied by the sub-feeding part to the image forming part.

According to an aspect of the invention, the main feeding part comprises a main feeding part main body which accommodates the feeding roller part and which is detachably mounted to the casing; and a main feeding cassette part which is spaced from the main feeding part main body and which stores the printing medium.

According to an aspect of the invention, the main feeding cassette part comprises: a knock-up plate in which the printing medium is stored; a main pick-up roller which picks up the printing medium in the knock-up plate; and a registration roller which aligns a leading edge of the printing medium picked up in the main pick-up roller and which transfers the printing medium to the image forming part.

According to an aspect of the invention, the feeding roller part comprises: a sub pick-up roller which picks up the printing medium in the sub-feeding part; and a feeding roller which transfers the printing medium transferred to the reversing part and the printing medium picked up by the sub pick-up roller to the image forming part.

According to an aspect of the invention, the feeding roller part comprises a second guide member which is provided on one side of the feeding roller and guides the printing medium guided through the first guide member to the feeding roller.

According to an aspect of the invention, the feeding roller feeds the printing medium transferred to the reversing path and the printing medium picked up in the sub pick-up roller to the registration roller.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
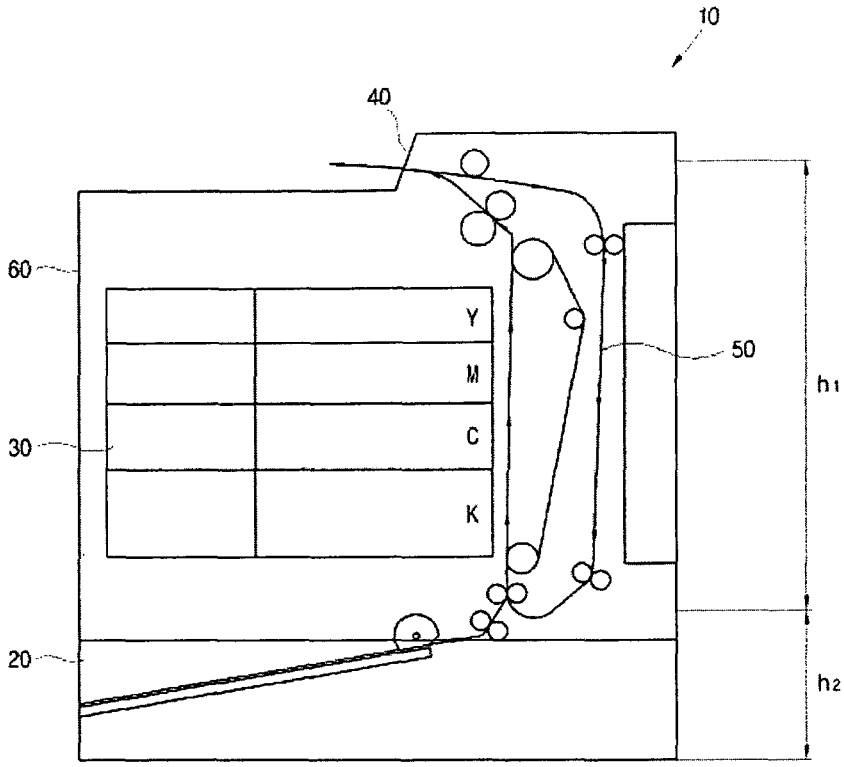
RELATED ART FIG. 1
FIG. 1 is a sectional view schematically illustrating a configuration of a conventional image forming apparatus.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 2:
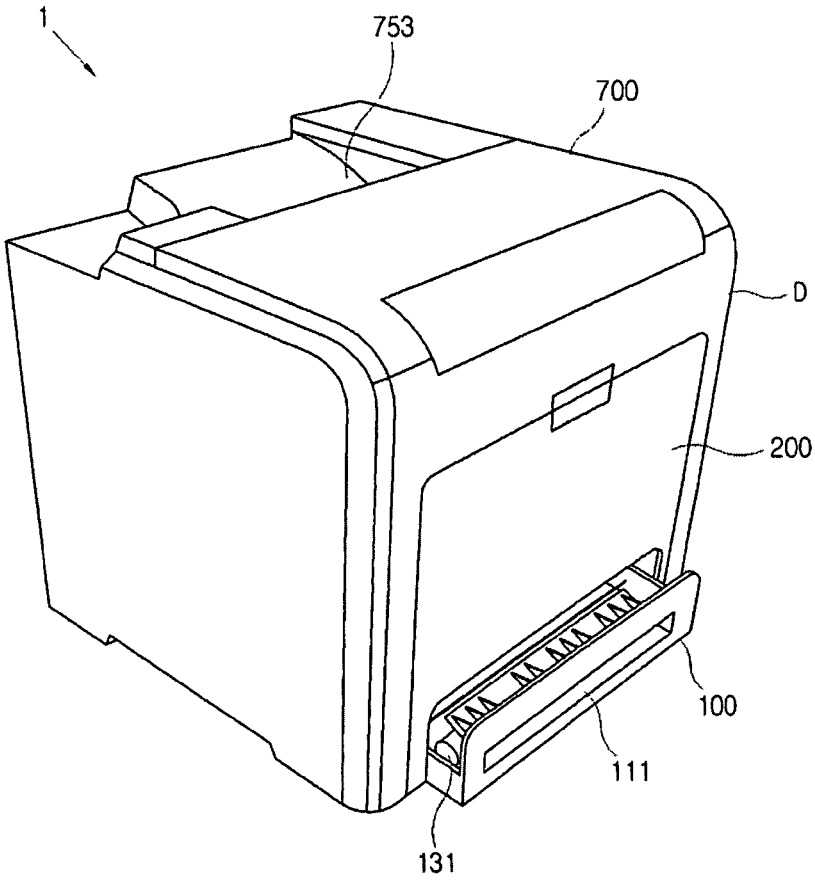
FIG. 2 is a perspective view illustrating an exterior configuration of an image forming apparatus according to an example embodiment of the present invention.
Figure 3:
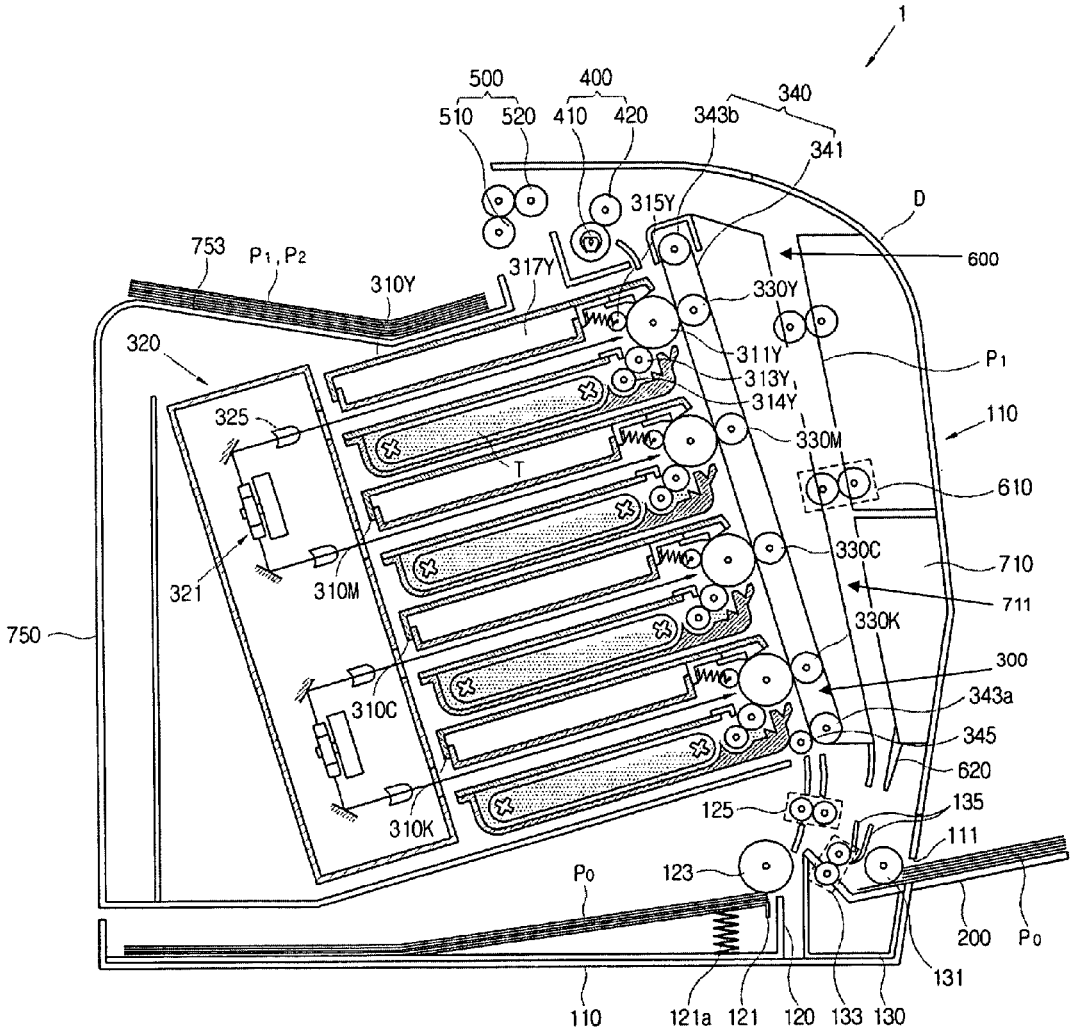
FIG. 3 is a sectional view illustrating an interior configuration of an image forming apparatus according to an example embodiment of the present invention.

FIG. 2 is a perspective view illustrating an exterior configuration of an image forming apparatus 1 according to an example embodiment of the present invention, and FIG. 3 is a sectional view illustrating an interior configuration of an image forming apparatus 1 according to an example embodiment of the present invention. Such an image forming apparatus can be a printer, a photo-copier, a facsimile machine or a multi-functional product. As shown in FIGS. 2 and 3, the image forming apparatus 1 comprises a main feeding part 100, a sub-feeding part 200, an image forming part 300, a fusing part 400, a discharging part 500, a reversing part 600, and a main body 700 which supports all the components.

The main feeding part 100 transfers a printing medium, such as paper, P0 stored in a main feeding cassette part 120 or in a sub-feeding part 200. The main feeding part 100 also transfers a printing medium P1, having an image formed on a first surface thereof, from a reversing part 600 to an image forming part 300. The image forming part 300 forms images on the printing media P0 and P1. The fusing part 400 fuses the images formed in the image forming part 300. The discharging part 500 discharges the printing medium from the fusing part 400. The reversing part 600 re-feeds the printing medium P1 toward a feeding roller part 130 according to a selection of a user to initiate a duplex printing operation. The main body 700 has a main frame 710 supporting the above-described components.

Hereinafter, the reference numeral P0 refers to a printing medium on which no image is formed. Conversely, the reference numeral P1 refers to the same printing medium on which an image is formed on one side thereof. The reference numeral P2 refers to the same printing medium on which an image is formed on both sides thereof.

The main feeding part 100 according to an example embodiment of the present invention comprises a main feeding part main body 110 that is attachable and/or detachable with respect to the main body 700. A main feeding cassette part 120 is provided on an opposite side of a feeding inlet 111 of the main feeding part main body 110 and stores the printing medium P0. The feeding roller part 130 transfers the printing medium P1 from the reversing part 600 and the printing medium P0 transferred from the sub-feeding part 200 to the image forming part 300.

As shown in FIGS. 2 and 3, the main feeding part main body 110 is detachably mounted to the main body 700. The main feeding part main body 110 is mounted to the main body 700 and transfers the printing medium P0 to the image forming part 300 according to a receipt of a printing signal. Also, if the supply of the printing medium P0 is exhausted or a jam occurs, the main feeding part main body 110 may be separated from the main body 700 to allow for a loading of a printing medium P0 or to allow for a solution to the jam.

The main feeding part main body 110 has a feeding inlet 111 that allows for the feeding of the printing medium P0 in the sub-feeding part 200 inside the main body 700. If the sub-feeding part 200 is pivotally rotated from the main body 700 to a feeding position, the feeding inlet 111 allows the printing medium P0 of the sub-feeding part 200 to contact a sub pick-up roller 131.

The main feeding cassette part 120 is provided in a rear area of the main feeding part main body 110 and supplies the stored printing medium P0 to the image forming part 300. The main feeding cassette part 120 comprises a knock-up plate 121 on which printing media, including the printing medium P0, are stacked. A main pick-up roller 123 separates the printing medium P0 from the stack. A registration roller 125 aligns a leading edge of both the picked up printing medium P0 and the printing medium P1. The registration roller 125 also supplies the printing medium P0 and the printing medium P1 to the image forming part 300. The knock-up plate 121 is biased to move toward the main pick-up roller 123 and enables the printing medium P0 stored on the top of the stack of printing media to contact the main pick-up roller 123 if the main feeding part 100 is mounted to the main body 700.

The main pick-up roller 123 rotates in contact with the printing medium P0 stored on the top of the stack of printing media on the knock-up plate 121 if the printing signal is applied. The main pick-up roller 123 then separates the printing medium P0 from the stack by a frictional force generated between the printing medium P0 and the main pick-up roller 123 when rotating. At this time, the main pick-up roller 123 applies a larger frictional force than that which is generated between the printing medium P0 on the top of the stack and the next printing medium in the stack. This prevents an overlapped transfer of the printing medium P0.

The registration roller 125 aligns the leading edge of the printing medium P0, having been separated from the knock-up plate 121, and supplies the printing medium P0 to a transfer belt 341 of the image forming part 300. The registration roller 125 may be a center alignment type of registration roller, which aligns the printing medium P0 from a central area of the leading edge of the printing medium P0 to a side area, and a side alignment type of registration roller, which aligns the printing medium P0 from a side area of the leading edge of the printing medium P0. Further description of the configuration of the registration roller 125 will be omitted as it is a known technology.

The feeding roller part 130 comprises a sub pick-up roller 131, which separates the printing medium P0 stored in the sub-feeding part 200 from other printing media. A feeding roller 133 transfers the printing medium P0 separated by the sub pick-up roller 131 and the printing medium P1 on which an image is formed on a first surface thereof and which is transferred from the printing medium reversing part 600 to the registration roller 125. A second guide member 135 guides the printing medium P1 transferred from the printing medium reversing part 600 to the feeding roller 133.

The sub pick-up roller 131 is provided on one side of the feeding inlet 111 and picks up a printing medium at a top portion of the sub-feeding part 200 that is proximate to the inside of the main body 700. The description of the sub pick-up roller 131 will be omitted as this feature has the same configuration as that of the main pick-up roller 123.

The feeding roller 133 feeds the printing medium P0 separated by the sub pick-up roller 131 to the registration roller 125, and changes the feeding direction of the printing medium P1 on which an image is formed on a first surface thereof and which is fed through the reversing part 600 to transfer the printing medium P1 to the registration roller 125. A feeding direction of the printing medium P1 is changed toward the image forming part 300 by the feeding roller 133 to allow for the second surface of the printing medium P1 to contact each of the developing devices 310Y, 310M, 310C, and 310K.

The feeding roller 133 comprises a driving roller 133*a* which is rotated by a driving part (not shown), and a driven roller 133*b* which is rotated with the rotation of the driving roller 133*a*. The feeding roller 133 may be provided as a singular roller, or may be provided as a plurality of rollers according to a distance and a path from the sub pick-up roller 131 to the registration roller 125.

The second guide member 135 is provided on one side of the feeding roller 133 and guides the printing medium P1 to the feeding roller 133. The feeding roller 133 is provided inside the main feeding part 100 to be detachably mounted to the main body 700 and to be separate from a reversing path 711 (see FIGS. 3 and 4) provided in the main body frame 710. However, the printing medium P1 tends to move in a substantially straight proceeding direction as a result of the rigidity thereof. Accordingly, the second guide member 135 guides the printing medium P1, having passed through the reversing path 711 to the feeding roller 133, to enable the feeding direction of the printing medium P1 to be changed in a stable manner.

The second guide member 135 may have a length and a shape that each correspond to a portion of the space from one end part of the reversing path 711 to the feeding roller 133. Also, the second guide member 135 may be straight or curved. The second guide member 135 may comprise a pair of members to guide both a front surface and a rear surface of the printing medium. The second guide member 135 may be adhered on one side of the feeding roller 133 as a separate member, or may be integrated with the main feeding part main body 110.

The sub-feeding part 200 is coupled to a casing 750 of the main body 700 to allow the sub feeding part 200 to be pivotally rotated and may store printing media having different sizes or characteristics (i.e., OHP film, photographic paper, scratch paper, or B4 and B5 size paper) than the printing medium P0. The sub-feeding part 200 is coupled to the casing 750 of the main body 700 as shown in FIG. 2 if a user does not want to use it. Also, the sub-feeding part 200 is pivotally rotated in a predetermined angle with respect to the casing 750 as shown in FIG. 3 to supply the printing medium P0 to the feeding inlet 111 if the user does want to use it.

The image forming part 300 forms an image on a first surface of the printing medium P0 fed from the main feeding part 100 and the sub-feeding part 200, and forms an image on the second surface of the printing medium P1. The image forming part 300 may be an ink jet which forms an image by ejecting ink onto the printing medium, an electrophotographic type which selectively spreads developer on the printing medium P0 or P1 according to a potential difference between a photosensitive body and a developer, and a direct thermal type which applies heat and pressure to an ink ribbon on which ink is coated and transfers the ink to the printing medium P0 or P1 to form an image thereon.

The image forming part 300 according to an example embodiment of the present invention employs a color electrophotographic method. The image forming part 300 comprises four developing devices 310Y, 310M, 310C, and 310K that are provided to form yellow, magenta, cyan, and black images to form a full color image in a single pass of the printing medium P0 or P1 through the image forming part 300.

The plurality of developing devices 310Y, 310M, 310C, and 310K spread developer T of each color onto the printing media P0 and P1. An exposure part 320 scans light on the surface of photosensitive bodies 311Y, 311M, 311C, and 311K of each of the developing devices 310Y, 310M, 310C, and 310K, respectively, to form an electrostatic latent image thereon. A plurality of transfer rollers 330Y, 330M, 330C, and 330K transfer the developer spread onto the photosensitive bodies 311Y, 311M, 311C, and 311K to the printing media P0 and P1. A feeding part 340 sequentially transfers the printing media P0 and P1 to the plurality of developing devices 310Y, 310M, 310C, and 310K.

The plurality of developing devices 310Y, 310M, 310C, and 310K comprise the photosensitive bodies 311Y, 311M, 311C, and 311K, developer storing parts 317Y, 317M, 317C, and 317K which accommodate developer T therein, developing rollers 313Y, 313M, 313C, and 313K which develop the developer on an electrostatic latent image of the photosensitive bodies 311Y, 311M, 311C, and 311K, supplying rollers 314Y, 314M, 314C, and 314K which supply the developer T for the developing rollers 313Y, 313M, 313C, and 313K, and electrifying rollers 315Y, 315M, 315C, and 315K which electrify the photosensitive bodies 311Y, 311M, 311C, and 311K to a predetermined potential. The description of a configuration of the developing devices 310Y, 310M, 310C, and 310K will be omitted as it is similar to that of the conventional configuration.

The exposure part 320 scans a beam onto each of the photosensitive bodies 311Y, 311M, 311C, and 311K provided in each of the developing devices 310Y, 310M, 310C, and 310K to form an electrostatic latent image on each of the bodies. The exposure part 320 has a multi-beam light scanning configuration to allow the exposure part 320 to scan the beam to the plurality of photosensitive bodies 311Y, 311M, 311C, and 311K simultaneously. The exposure part 320 comprises a light source (not shown), a polygon mirror 321 which cause the beam to be inclined, and an f-θ lens 325 which scans the beam inclined in the polygon mirror 321 onto a surface to be scanned to form an image. The light source (not shown) may have a plurality of luminosities, or may be provided with a semiconductor element having a single luminosity to correspond to the respective colors. As shown in FIG. 3, the polygon mirror 321 is provided as a pair of mirrors, and the pair allows two beams to be scanned onto different paths. The f-θ lens 325 along with a lens is provided on each of the four paths. Accordingly, the f-θ lens 325 can separately scan the beam with respect to the plurality of photosensitive bodies 311Y, 311M, 311C, and 311K which are disposed to be adjacent each other.

The transfer rollers 330Y, 330M, 330C, and 330K face each of the photosensitive bodies 311Y, 311M, 311C, and 311K across the printing media P0 and P1 which are transferred along a transfer belt (PTB). Also, the transfer rollers 330Y, 330M, 330C, and 330K apply a predetermined transfer voltage to rear surfaces of the printing media P0 and P1 to transfer the developer spread on the surface of the photosensitive bodies 311Y, 311M, 311C, and 311K to the printing media P0 and P1. The transfer rollers 330Y, 330M, 330C, and 330K recognize a resistance value of the printing media as having different values according to the thickness and the material of the transferred printing media and apply an optimum transfer voltage corresponding to the resistance value.

The feeding part 340 feeds the printing media P0 and P1 to sequentially spread the developer from each of the photosensitive bodies 311Y, 311M, 311C, and 311K to form an image on the printing media P0 and P1. The feeding part 340 comprises a transfer belt (PTP) which adsorbs the printing medium whose leading edge is aligned in the registration roller 125 onto a surface thereof by static electricity and rotates, a belt driving roller 343 which drives the rotation of the transfer belt 341, and a belt electrifying roller 345 which electrifies the surface of the transfer belt 341. The description of the configuration of the feeding part 340 will be omitted as it is similar to that of a conventional configuration thereof.

The fusing part 400 fuses the developer on the surface of the printing medium P1 whose first surface is previously printed on and printing medium P2 whose second surface is previously printed on by applying heat and pressure to the printing media P0, P1, and P2. The fusing part 400 comprises a heating roller 410 and a pressing roller 420 which apply heat and pressure, respectively, to the printing media P0, P1 and P2.

The discharging part 500 discharges the image-formed printing media P0, P1 and P2 through the fusing process in the fusing part 400 to a storing part 753 of the casing 750. The discharging part 500 comprises a discharging roller 510 which discharges the printing media P0, P1 and P2, and a reverse roller 520 which changes a feeding direction of the printing medium P1 according to a user's duplex printing signal and transfers the printing medium P1 to the printing medium reversing part 600. Also, the discharging part 500 may further comprise a reversing lever (not shown) which guides the printing medium P1 to the printing medium reversing part 600.

The reversing part 600 transfers the printing medium P1 from the reverse roller 520 and toward the feeding roller 133 of the main feeding part 100. The reversing part 600 comprises a reversing roller 610 provided along the reversing path 711 formed in the main body frame 710. The reversing roller 610 may comprise a plurality of rollers according to the length and the path of the reversing path 711.

The reversing part 600 also comprises a first guide member 620 which stably guides the printing medium P1 transferred through the paper reversing path 711 to the feeding roller 133 in an outlet area of the reversing path 711. The first guide member 620 may comprise a pair of members on opposite sides of the reversing path 711.

The main body 700 comprises a main body frame 710 supporting the above-described components, and a main body casing 750 to protect the main body frame 710 and the components from an external impact. The main body frame 710 includes the reversing path 711 to guide the printing medium P1 to be transferred to the feeding roller 133 of the main feeding part 100. The reversing path 711 may have a length corresponding to the height of the plurality of developing devices 310Y, 310M, 310C, and 310K.

The main body casing 750 is coupled to the sub-feeding part 200. The main body casing 750 comprises a storing part 753 which stores the printing media P1 and P2.

Hereinafter, a process for use with the image forming apparatus 1 will be described.

First, a one-sided printing process in which a user forms an image on one surface of the printing medium P0 stored in the main feeding cassette part 120 (see A in FIG. 4) will be described. If a printing signal is applied, the main pick-up roller 123 is rotated to pick up the printing medium P0. The picked-up printing medium P0 is aligned in the registration roller 125 to be transferred to the image forming part 300.

The transfer belt 341 applies a static electric force to the printing medium P0 electrified by the belt electrifying roller 345 and transferred from the registration roller 125 to adsorb the printing medium P0 on its surface. As the belt driving rollers 343*a* and 343*b* are driven, the transfer belt 341 is rotated and the printing medium P0 sequentially contacts each of the photosensitive bodies 311Y, 311M, 311C, and 311K. At this time, the developer of each color is spread on the surface of the printing medium P0 to form an image.

The fusing part 400 fuses the developer by an application of heat and pressure. Accordingly, the printing medium P0, on which an image is formed on its first surface and which is now referred to as printing medium P1, is discharged by the discharging roller 510.

If the user selects duplex printing (see B in FIG. 4), the procession of the printing medium P1 is reversed by the reverse roller 520 of the discharging roller 510 to re-enter the main body 700. Also, the printing medium P1 is guided by a direction changing lever (not shown) to enter the reversing path 711. The printing medium P1 having entered the reversing path 711 is then transferred by the reversing roller 610 and guided to the second guide member 135 by the first guide member 620 to then be guided to the feeding roller 133.

The direction of the feeding of the printing medium P1 is changed by the feeding roller 133, and, at this time, the second surface of the printing medium P1 is caused to face the photosensitive bodies 311Y, 311M, 311C, and 311K. The printing medium P1 passes through the registration roller 125 to be aligned, and an image is then formed on the second surface in the image forming part 300. Then, the printing medium P2 is discharged through the discharging part 500.

Figure 4:
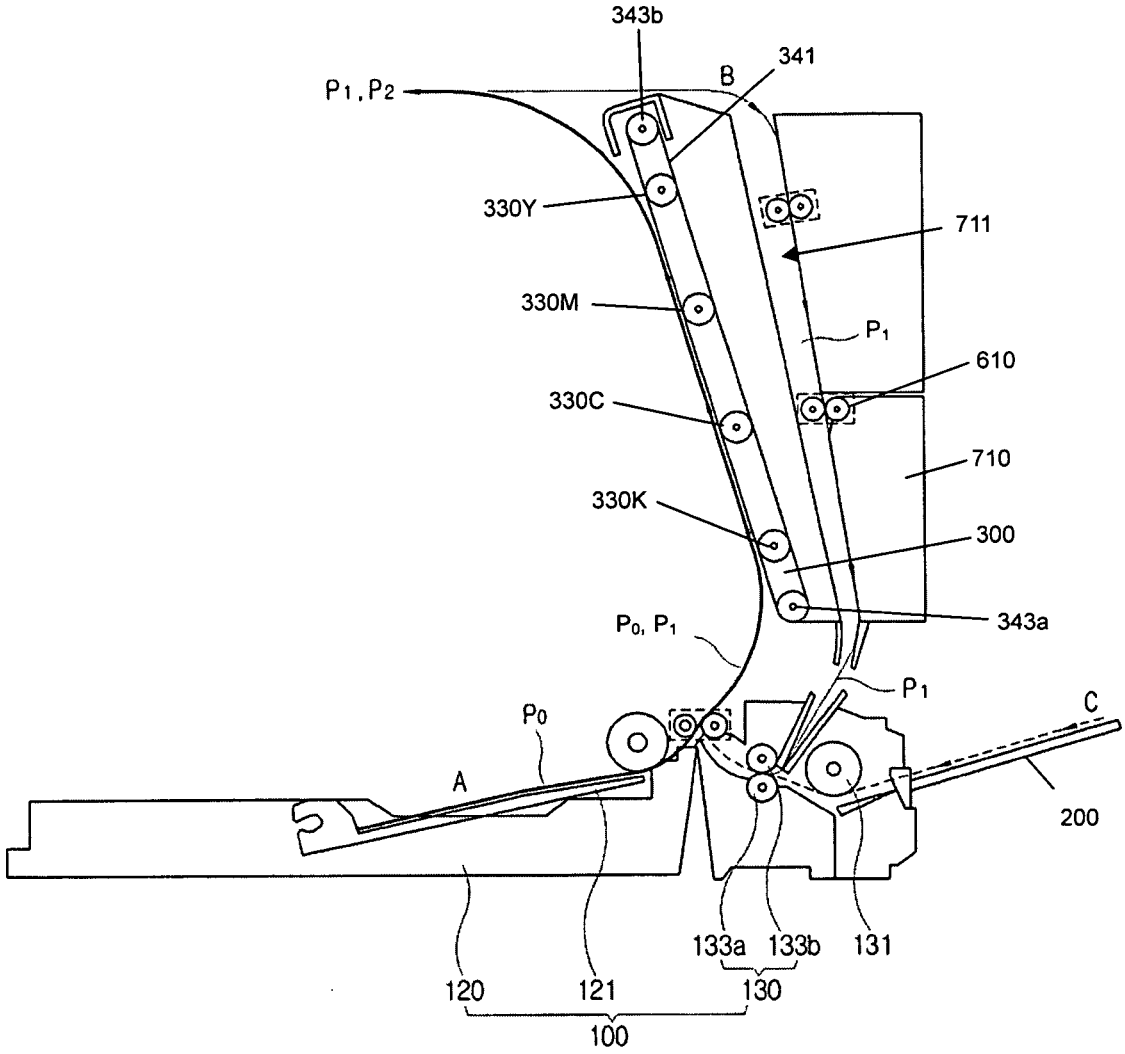
FIG. 4 is a schematic view illustrating a feeding configuration of an image forming apparatus according to an example embodiment of the present invention.

Meanwhile, an image forming process of the printing medium P0 stored in the sub-feeding part 200 will be described by referring to C in FIG. 4. The printing medium P0 stored in the sub-feeding part 200 enters, by the rotation of the sub pick-up roller 131, the inside of the main body 700 through the feeding inlet 111. The printing medium P0 is then guided through the feeding roller 133 to the registration roller 125, and passes through the image forming part 300 to have an image-formed thereon.

As is described above, in the image forming apparatus according to aspects of the present invention, a feeding roller which has been provided separately in a conventional duplex printing part is, according to an aspect of the present invention, provided in the inside of a main feeding part to thereby minimize the height of the duplex printing part. Also, the number of the feeding rollers provided in the duplex printing part and the main feeding part may be reduced to lower production costs.

Also, in the image forming apparatus, according to aspects of the present invention, a feeding roller part to feed a printing medium of the sub-feeding part is integrated with the main feeding part to save space and to minimize the size of the image forming apparatus. The image forming apparatus, according to aspects of the present invention has employed a single-pass color electrophotographic type, but it may be applied to a multi-pass color electrophotographic type, and a mono electrophotographic type. Also, the image forming apparatus according to aspects of the present invention may be applied to a multi-function printer comprising a scanner and a facsimile.

As is described above, the image forming apparatus, according to aspects of the present invention, provides at least the following two effects. First, a feeding roller part to feed a printing medium, of a duplex printing part and a main feeding part, is integrated with the main feeding part to minimize the size of the main body. Second, since the duplex printing part and the sub-feeding part share one feeding roller, it has a simple configuration and less components, thereby saving production costs and improving an assembling configuration.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A color image forming apparatus for forming a color image on a printing medium, the color image forming apparatus comprising:

a main body;

a pick-up unit to pick up the printing medium;

a paper tray part attachable and detachable with respect to the main body, which accommodates the printing medium, the paper tray part further including a pair of registration rollers which aligns a leading edge of the printing medium picked up by the pick-up unit;

an image forming part included in the main body, which forms a color image on a printing medium, the image forming part including a transfer belt which transfers the printing medium, and a plurality of developing devices which are disposed in relation to the transfer belt and sequentially from a lower part to an upper part of the main body;

a path provided within the main body that serves to move the printing medium in a direction;

a reversing path provided within the main body that serves to reverse the direction of the printing medium on which an image is formed on a first surface thereof by the image forming part, the reversing path configured to allow the printing medium to pass through a portion of the paper tray part, and a sub-feeding part to feed a printing medium from outside of a casing and that supplies the printing medium to an interior of the casing, wherein the registration rollers are positioned along the path and the reversing path, wherein the paper tray part includes a feeding roller part which re-feeds the printing medium, being transferred via the reversing path and passing through the portion of the paper tray part, to the registration rollers, wherein the registration rollers and the feeding roller part included in the paper tray part move together with the paper tray part as a single unit, as the paper tray part is moved into or out of the main body, wherein the reversing path is configured to transfer the printing medium in a reverse direction of forming the color image sequentially by the plurality of developing devices, and wherein the feeding roller part included in the paper tray part transfers each of the printing medium passed through the reversing path and the printing medium supplied by the sub-feeding part to the registration rollers included in the paper tray part.

2. The color image forming apparatus according to claim 1, wherein the feeding roller part transfers the printing medium supplied by the sub-feeding part to the image forming part.

3. The color image forming apparatus according to claim 2, wherein the paper tray part comprises:

a main feeding part main body which accommodates the feeding roller part and which is detachably mounted to the casing; and a main feeding cassette part which is spaced from the main feeding part main body and which stores the printing medium.

4. The color image forming apparatus according to claim 3, wherein the main feeding cassette part comprises:

a knock-up plate on which the printing medium is capable of being stored.

5. The color image forming apparatus according to claim 4, wherein the feeding roller part comprises:

a sub pick-up roller which picks up the printing medium in the sub-feeding part; and a feeding roller which transfers the printing medium transferred to the reversing path and the printing medium picked up by the sub pick-up roller to the image forming part.

6. The color image forming apparatus according to claim 5, wherein a reversing roller is provided on the reversing path and which transfers the printing medium, wherein, a first guide member which guides the printing medium to the feeding roller part is provided in one end part of the reversing path.

7. The color image forming apparatus according to claim 6, wherein the feeding roller part comprises a second guide member which is provided on one side of the feeding roller part and which guides the printing medium, the printing medium having been guided through the first guide member to the feeding roller part.

8. The color image forming apparatus according to claim 5, wherein the feeding roller part feeds the printing medium, the printing medium having been transferred to the reversing path and the printing medium having been picked up in the sub pick-up roller to the registration rollers.

9. A color image forming apparatus for forming a color image on a printing medium, the color image forming apparatus comprising:

a main body;

a paper tray part attachable and detachable with respect to the main body, which accommodates the printing medium;

a pick-up unit to pick up the printing medium from the paper tray part;

a pair of registration rollers which aligns a leading edge of the printing medium;

an image forming part included in the main body, which forms a color image on a printing medium, the image forming part including a transfer belt which transfers the printing medium along a path, and a plurality of developing devices which are disposed in a relation to the transfer belt and sequentially from a lower part to an upper part of the main body;

a reversing path provided within the main body that serves to reverse a printing side of the printing medium after printing operation is performed on a first surface thereof by the image forming part, the reversing path configured to allow the printing medium to pass through a portion of the reversing path located between the transfer belt and a cover of the main body and to allow the printing medium to be guided via a portion of the paper tray part to the image forming part so as to perform printing operation on a second surface of the print medium; and a sub-feeding part to feed a printing medium from outside of a casing and that supplies the printing medium to an interior of the casing, wherein the reversing path is configured to transfer the printing medium in a reverse direction of forming the color image sequentially by the plurality of developing devices, wherein the registration rollers are positioned along the path and the reversing path, and wherein a feeding roller included in the paper tray part transfers each of the printing medium passed through the reversing path and the printing medium supplied by the sub-feeding part to the registration rollers included in the paper tray part.

10. The color image forming apparatus according to claim 9, wherein a feeding roller transfers the printing medium supplied by the sub-feeding unit to the image forming unit.

11. The color image forming apparatus according to claim 10, wherein the paper tray comprises:

a main body to accommodate the feeding roller and to detachably mount to the casing; and a main feeding cassette, spaced from the main body, to store the printing medium.

12. The color image forming apparatus according to claim 11, wherein the main feeding cassette comprises:

a knock-up plate to store the printing medium.

13. The color image forming apparatus according to claim 12, wherein the feeding roller comprises:

a sub pick-up roller to pick up the printing medium from the sub-feeding unit; and a feeding roller to transfer the printing medium, having been transferred to the reversing unit, and the printing medium, having been picked up by the sub pick-up roller, to the image forming unit.

14. The color image forming apparatus according to claim 13, wherein:

a reversing roller is provided on the reversing path, to transfer the printing medium; and a first guide member to guide the printing medium to the feeding roller, the first guide member being provided in one end part of the reversing path.

15. The color image forming apparatus according to claim 14, wherein the feeding roller comprises a second guide member, provided on one side of the feeding roller, to guide the printing medium, the printing medium having been guided through the first guide member to the feeding roller.

16. The color image forming apparatus according to claim 13, wherein the feeding roller feeds the printing medium, the printing medium having been transferred to the reversing path and the printing medium having been picked up in the sub pick-up roller to the registration rollers.

17. The color image forming apparatus according to claim 9, wherein the registration rollers included in the paper tray part moves together with the paper tray part of a single unit, as the paper tray part is moved into or out of the main body.

18. The color image forming apparatus according to claim 9, further comprising a feeding roller part to feed the printing medium, being transferred via the reversing path to the registration rollers.

19. The color image forming apparatus according to claim 9, wherein the printing medium is guided via the portion of the paper tray part after the feeding roller part feeds the printing medium being transferred via the reversing path.

20. The color image forming apparatus according to claim 9, wherein the feeding roller part is incorporated in the paper tray part.

21. An image forming device comprising:

a main body;

a path provided within the main body that serves to move the printing medium in a direction;

a reversing path provided within the main body that serves to reverse the direction of a printing medium on which an image is formed on a first surface thereof by the image forming device, the reversing path having an outlet area;

a sub-feeding part to feed a printing medium from outside of a casing and that supplies the printing medium to an interior of the casing; and a paper tray part comprising a pair of registration rollers and a feeding roller that re-feeds the printing medium being transferred via the outlet area of the reversing path to the feeding roller and passing through a portion of the paper tray part to the registration rollers that align a leading edge of the printing medium picked up by a pick-up unit, wherein the registration rollers are positioned along the path and the reversing path, and wherein the feeding roller transfers each of the printing medium passed through the reversing path and the printing medium supplied by the sub-feeding part to the registration rollers.

* * * * *